US009464784B2

(12) United States Patent
Yoder et al.

(10) Patent No.: US 9,464,784 B2
(45) Date of Patent: Oct. 11, 2016

(54) OPTICAL SYSTEM AND LIGHTING DEVICE COMPRISED THEREOF

(75) Inventors: Benjamin Lee Yoder, Cleveland Heights, OH (US); Mark Edward Kaminski, Beachwood, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 13/365,949

(22) Filed: Feb. 3, 2012

(65) Prior Publication Data

US 2013/0201722 A1 Aug. 8, 2013

(51) Int. Cl.

| | |
|---|---|
| ***F21V 7/00*** | (2006.01) |
| ***F21V 13/04*** | (2006.01) |
| ***F21V 5/04*** | (2006.01) |
| *F21Y 101/00* | (2016.01) |

(52) U.S. Cl.

CPC ..... *F21V 13/04* (2013.01); *F21K 9/23* (2016.08); *F21V 5/045* (2013.01); *F21V 5/046* (2013.01); *F21V 7/0091* (2013.01); *F21Y 2101/00* (2013.01)

(58) Field of Classification Search

CPC ..... F21K 9/13; F21K 9/137; F21K 9/1375; F21V 13/04; F21V 5/045; F21V 5/046; F21V 7/0091

USPC ..... 362/257, 296.01, 297, 299, 300, 302, 362/304, 307, 310, 296.05, 296.08, 311.02, 362/311.06, 317, 326, 327, 336, 341, 373, 362/308; 359/409

See application file for complete search history.

(56) References Cited

U.S. PATENT DOCUMENTS

| | | | | |
|---|---|---|---|---|
| 1,986,065 | A | 1/1935 | Maillet | |
| 4,340,283 | A | 7/1982 | Cohen | |
| H423 | H | 2/1988 | Mohon et al. | |
| 5,539,622 | A * | 7/1996 | Ishikawa | 362/16 |
| 5,760,871 | A | 6/1998 | Kosoburd et al. | |
| 5,947,587 | A * | 9/1999 | Keuper et al. | 362/235 |
| 6,046,847 | A | 4/2000 | Takahashi | |
| 6,724,543 | B1 * | 4/2004 | Chinniah et al. | 359/718 |
| 6,997,571 | B2 * | 2/2006 | Tenmyo | 362/16 |

(Continued)

FOREIGN PATENT DOCUMENTS

| | | |
|---|---|---|
| EP | 0772077 | 5/1997 |
| EP | 0828112 A1 | 3/1998 |

(Continued)

OTHER PUBLICATIONS

Search Report and Written Opinion from corresponding PCT Application No. PCT/US2013/023853, dated May 6, 2013.

*Primary Examiner* — Peggy Neils
*Assistant Examiner* — Alexander Garlen
(74) *Attorney, Agent, or Firm* — GE Global Patent Operation; Peter T. DiMauro

(57) ABSTRACT

The present disclosure describes embodiments of an optical system for use in a lighting device, e.g., replacements for MR/PAR/R directional lamps. In one embodiment, the optical system comprises optical elements (e.g., a lens element) with features that form light from a light source into a light beam. In one embodiment, the optical elements have a plurality of focus points, which do not all converge to a single focus point proximate the light source. Rather one or more of the focus points are spaced apart from the light source so the collective configuration of focus points causes the light beam to exhibit favorable characteristics.

10 Claims, 4 Drawing Sheets

(56) References Cited

U.S. PATENT DOCUMENTS

| | | | | |
|---|---|---|---|---|
| 7,160,522 | B2 * | 1/2007 | Minano Dominguez et al. | 422/186.3 |
| 7,270,454 | B2 * | 9/2007 | Amano | 362/522 |
| 7,410,275 | B2 * | 8/2008 | Sommers et al. | 362/335 |
| 7,580,192 | B1 * | 8/2009 | Chu et al. | 359/641 |
| 2006/0109669 | A1 | 5/2006 | Tanaka | |
| 2008/0144328 | A1 * | 6/2008 | Yagi et al. | 362/516 |
| 2010/0034072 | A1 | 2/2010 | Mizuyama | |
| 2011/0134636 | A1 | 6/2011 | Chang et al. | |

FOREIGN PATENT DOCUMENTS

| | | | |
|---|---|---|---|
| EP | 1524468 | A1 | 4/2005 |
| WO | 2008089757 | A1 | 7/2008 |

* cited by examiner

OPTICAL SYSTEM AND LIGHTING DEVICE COMPRISED THEREOF

BACKGROUND

1. Technical Field

The subject matter of the present disclosure relates to the illumination arts, lighting arts, solid-state lighting arts, and related arts.

2. Description of Related Art

Lighting fixtures including recessed lighting fixtures can use a floodlight bulb for general lighting tasks, a spotlight bulb that produces a relatively narrow beam of intense light, or other lamps for directional lighting. These directional lamps are useful to highlight a subject or an otherwise unlit area. Conventionally, the prior art utilizes individual imaging optical elements including lenses, reflectors, and total-internal-reflection (TIR) optics or combinations thereof to form the light emitted from the light source into a beam. These imaging elements are typically designed with a single focal point in order to perfectly collimate the light coming from an idealized point light source located at the focal point. Alternatively, selected examples of prior art instead utilize optical elements designed with more than one focal point, however, these focal points are still located along the optical axis.

A problem associated with these types of imaging optical systems is that any positional non-uniformities in the light source itself, either with respect to color or luminance, are directly translated into the light beam. These non-uniformities can be present in virtually all types of sources including incandescent, halogen, fluorescent, HID, and solid-state light sources. As a result, when the beam is directed onto a surface, these non-uniformities are projected onto the surface as well, resulting in a visually unappealing appearance of the light beam. To prevent this from occurring, diffusive elements such as lenslet arrays, holographically patterned films, and even surface roughened materials are introduced into the optical system to smooth out the non-uniformities in the light beam. Alternatively, some degree of diffusion can be achieved by slightly moving the source away from the focal point of the optical system. In either case, however, the added diffusion also serves to widen the overall light beam making it very difficult to efficiently form the narrow, intense beams desired for many applications. Thus, the improvement in visual appearance resulting from the added diffusion comes at the cost decreased optical performance.

BRIEF DESCRIPTION OF THE INVENTION

The present disclosure describes embodiments of an optical system for use in lighting devices. Embodiments of the lighting devices that are outfit with the optical system find use as replacements for a variety of lamps and lighting devices (e.g., MR/PAR/R directional lamps). As discussed more below, these embodiments deploy optical elements with features that form light from a light source into a light beam. In one embodiment, the optical elements have a plurality of focus points, which unlike conventional lenses and reflectors, do not all converge to a single focus point proximate the light source and off of the optical axis. Rather, one or more of the focus points are spaced apart from the light source so the collective configuration of focus points causes the light beam to exhibit favorable characteristics.

There are several characteristics that define the performance of these embodiments and, in particular, the properties of the light beam the embodiments of the optical system create. Measurements for these characteristics often occur in the far field (e.g., a distance at least 5-10 times the exit aperture size of the lamp and/or about one-half meter or further away from the lamp). The following definitions summarize one or more of the characteristics that can define a beam pattern that is peaked near the center of the light beam, on the optical axis of the optical system, with generally reduced intensity moving outward from the optical axis to the edge of the beam and beyond.

One characteristic is, for example, maximum beam intensity (also maximum beam candlepower (MBCP) or, since the MBCP can occur at or near the optical axis, center-beam candlepower (CBCP)). Maximum beam intensity measures the perceived brightness of the light at the maximum, or at the center, of the light beam. Another characteristic is beam width, which is represented by the full width at half maximum (FWHM). The FWHM is the angular width of the light beam at an intensity equal to one-half of the MBCP. Beam lumens is another characteristics that relates to FWHM. Beam lumens defines the integral of the lumens from the center of the light beam, outward to the intensity contour having one-half of the maximum intensity or, in another example, the lumens integrated out to the FWHM of the beam. In one example, if the integration of lumens continues outward in the light beam to the intensity contour having 10% of the maximum intensity, the integrated lumens may be referred to as the field lumens of the lighting device. On the other hand, if all of the lumens in the beam pattern are integrated, the result is referred to as the face lumens of the lighting device or, in another example, all of the light emanating from the face of the lighting device. The face lumens can be about the same as the total lumens, as measured in an integrating sphere, since typically little or no light the lamp emits comes from other than through the output aperture of the lamp.

The optical system maintains or improves on the desirable characteristics of the light beam that conventional directional lamps and other lighting devices generate. Use of the optical system can, for example, improve beam uniformity (i.e., color and intensity) and optical performance (e.g., center-beam candlepower (CBCP), beam angle, beam lumens) without adding additional cost to the overall lamp. In one embodiment, by improving beam uniformity at the lens level, examples of the lighting device that deploys the optical systems below can forgo use of certain diffusing elements, including moderate to heavily holographic diffusing films, because the optical system is so configured to perform functions of the diffusing element (e.g., smoothing of the light from the light source).

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
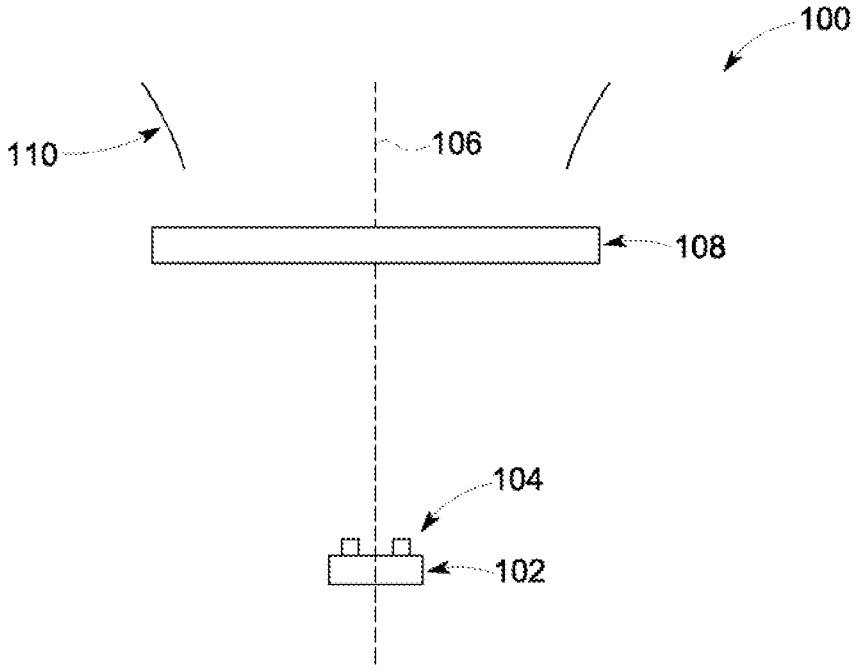
FIG. 1 depicts a schematic view of an exemplary optical system with one example of an optical element in the form of a lens element.

FIG. 1 illustrates a schematic diagram of an exemplary optical system 100. The optical system 100 has a light source 102. Examples of the light source 102 can have light-emitting diodes (LED) devices 104 forming an array as the primary light source. However, the optical system 100 of the present disclosure finds use in combination with a variety of other light-emitting devices, e.g., incandescent devices that use incandescent filaments, halogen devices that use a halogen capsule, fluorescent devices that use a fluorescent tube, high intensity discharge (HID) devices, and combinations thereof.

In the present example, the light source 102 is disposed on an optical axis 106. Light from the light source 102 impinges on an optical element 108, which is configured to form the light into a light beam 110. Examples of the optical element 108 can improve uniformity of the light beam (e.g., color and intensity) and maintain (or improve) optical performance (e.g., center-beam candle power (CBCP), beam angle, beam lumens, etc.) for the optical system 100 to satisfy design parameters, e.g., for directional lamps and other lighting devices. In one embodiment, the improvements in uniformity, e.g., to minimize non-uniformities that are the result of the light source 102, do not require additional physical components (e.g., lens elements and/or diffusing elements that are common in conventional directional lamps).

Figure 2:
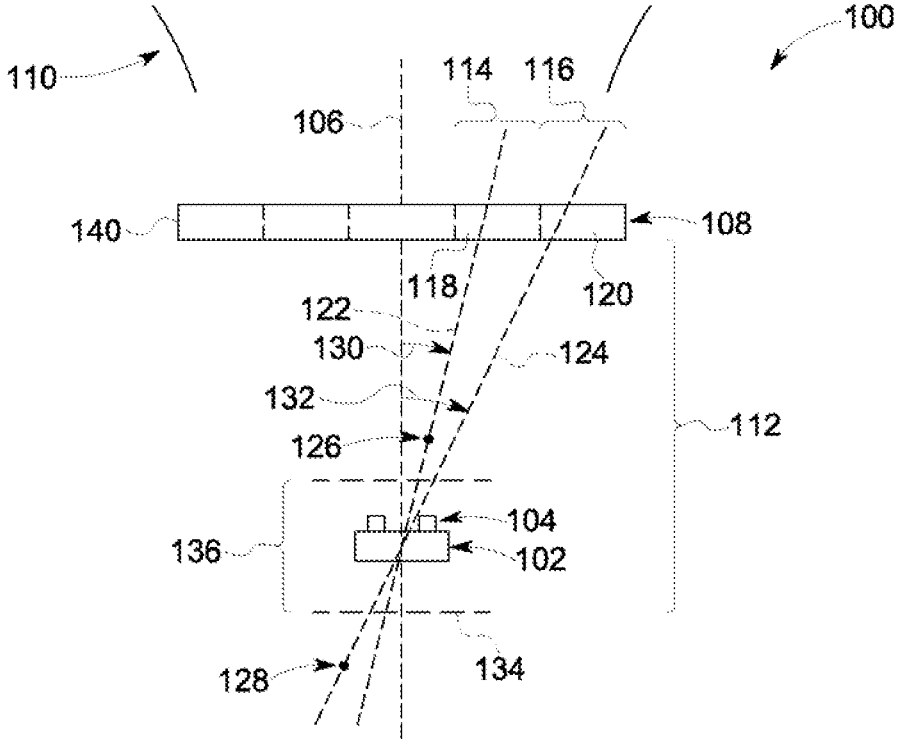
FIG. 2 depicts the optical system of FIG. 1.

As best shown in FIG. 2, the optical element 108 exhibits a focal signature 112 that defines the properties and characteristics of the light beam 110. The focal signature 112 can include one or more focus groupings (e.g., a first focus grouping 114 and a second focus grouping 116) that correspond to regions (e.g., a first region 118 and a second region 120) of the optical element 108. The focus groupings 114, 116 include a focus line (e.g., a first focus line 122 and a second focus line 124) and a focus point (e.g., a first focus point 126 and a second focus point 128). An offset angle (e.g., a first offset angle 130 and a second offset angle 132) defines the position of the focus lines 122, 124 relative to the optical axis 106. The illustration of FIG. 2 also shows a boundary 134 that defines an imaging region 136, which defines a region about the light source 102 in which the focus points of conventional lighting devices are found.

The optical element 108 can take the form of a lens element 140, wherein the regions 118, 120 can include individual optical facets that can direct light (e.g., refract and/or diffuse). These optical facets can comprise one or more concentric and/or adjacent rings of material (e.g., glass and/or polycarbonate). This material can be diffusive and/or transmissive and/or combinations thereof. As shown in FIG. 2, the optical facets can mate along adjacent edges to create substantially contiguous inner and outer surfaces of the lens element 140. In one example, the optical facets may be arranged so that construction of the optical element 108 is similar to construction of a Fresnel lens. In other examples, the optical element 108 can comprise optical facets that can reflect light, wherein one or more of the regions 118, 120 are reflective and/or partially reflective.

Design of the optical facets, e.g., selection of materials for the optical element 108 in the region 118, 120, curvature of the surfaces of the optical element 108 in the region 118, 120, and/or other physical features and characteristics of the optical element 108 in the regions 118, 120, may correspond to beam characteristics and/or performance that is desired for the light beam 110. The design of the optical facets can, in turn, determine the configurations and layout of focal signature 112. In one embodiment, the design of the optical facet (and, accordingly, the beam characteristics) define the position, orientation, and other features (e.g., the slope) of the focus lines 122, 124 and the position of the focus point 126, 128. In one example, the first offset angle 130 has a value that is different from the value of the second offset angle 132. Likewise the first focus point 126 can have different positions relative to the imaging regions 136 than the second focus point 128.

In the present example, the focus points 126, 128 for the optical element 108 are found outside of the imaging region 136 and spaced apart from the optical axis 106. In other examples, one or more of the focus points 126, 128 are found outside of the boundary 136 and one or more of the focus points 126, 128 are found inside of the boundary 136. This disclosure contemplates other configurations of the focal signature 112 in which at least one of the focus points 126, 128 reside on the optical axis. In context of the present disclosure, one or more of these combinations can cause the optical system 100 to form the light beam 110 with optical performance that reduces and/or eliminates certain non-uniformities the light source 102 may cause and which may show up as anomalies in the light beam 110.

Figure 3:
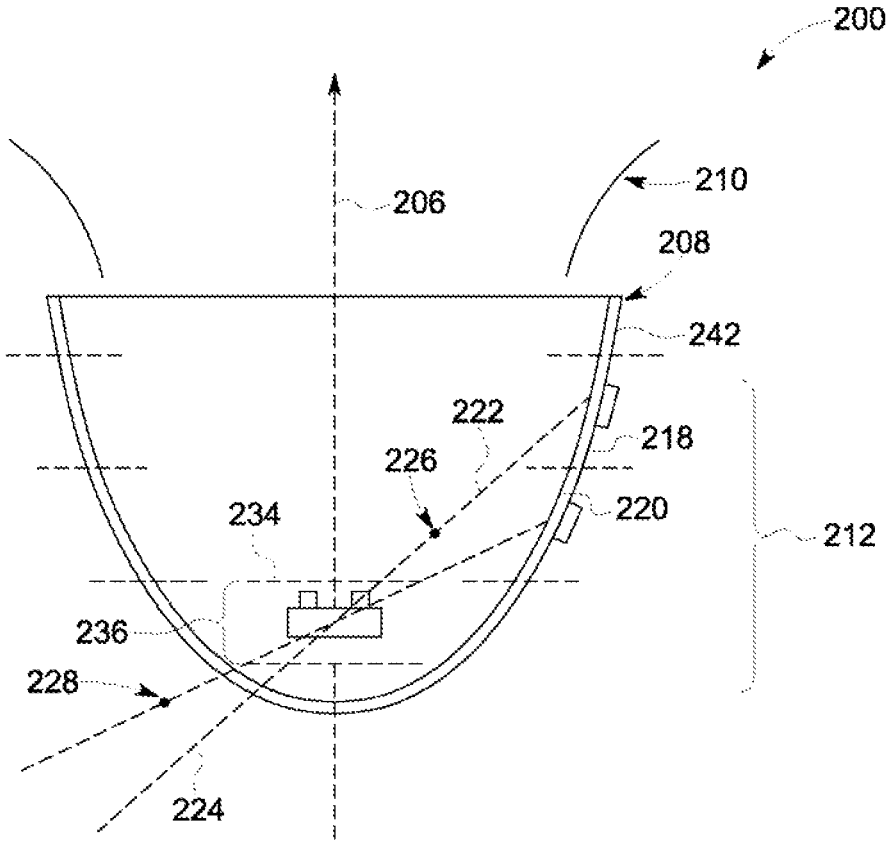
FIG. 3 depicts a schematic view of an exemplary optical system with another examples of an optical element in the form of a reflector element.

FIG. 3 illustrates a schematic diagram of another exemplary optical system 200. The optical system 200 includes a light source 202 on an optical axis 206. The optical system 200 also includes an optical element 208 with regions (e.g., a first region 218 and a second region 220). The optical element 208 in this example comprises a reflector element 242 that aligns with the optical axis 206. The reflector element 242 can have a parabolic shape as shown in FIG. 3 or can be configured with other shapes as desired.

In one example, the regions of the reflector element 242, e.g., the regions 218, 220, can have reflective properties that re-direct light from the light source 202. The re-directed light can form the light beam 210. As shown in FIG. 3, the optical element 208 can have a focal signature 212 with focus groupings, which in turn comprises focus lines (e.g., a first focus line 222 and a second focus line 224) and focus points (e.g., a first focus point 226 and a second focus point 228). The characteristics desired for the light beam 210 can determine the position of the focus lines 222, 224 and focus points 226, 228. In one embodiment, the focus points 226, 228 for the optical element 208 are found outside of the imaging region 236 and spaced apart from the optical axis 206.

Figure 4:
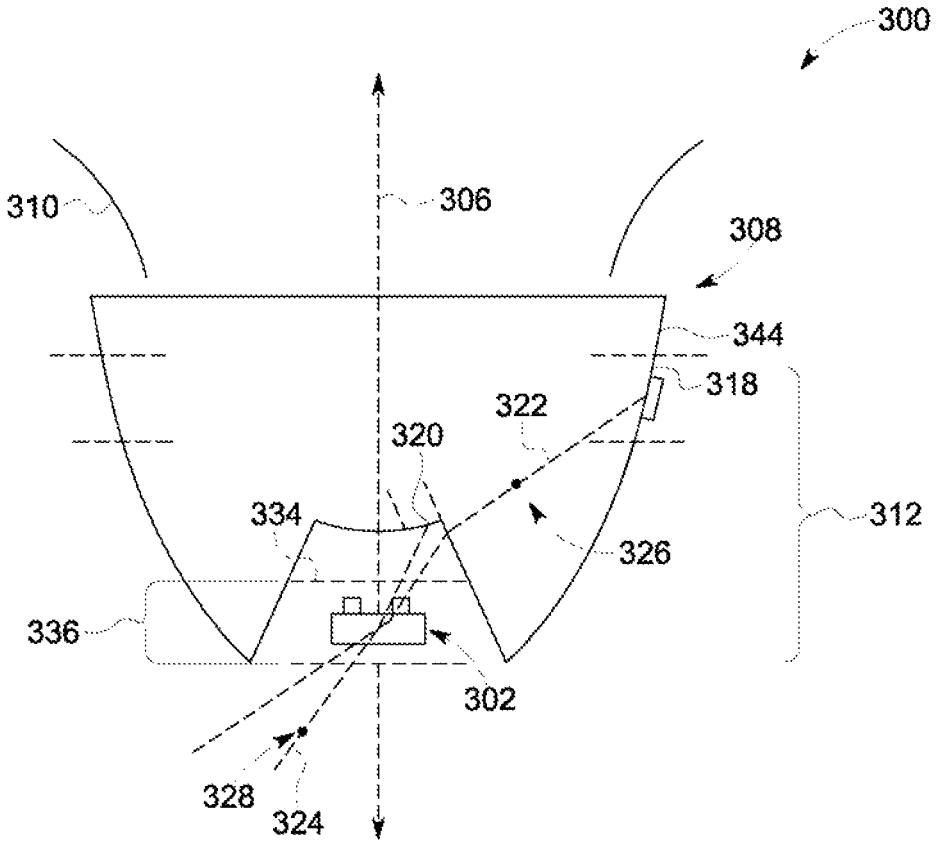
FIG. 4 depicts a schematic view of an exemplary optical system with yet another example of an optical element in the form of a total internal reflection element.

FIG. 4 illustrates a schematic diagram of yet another exemplary optical system 300. The optical system 300 includes a light source 302 on an optical axis 306. The optical system 300 also includes an optical element 308 with regions (e.g., a first region 318 and a second region 320). The optical element 308 in this example comprises a total internal reflection element 344 that aligns with the optical axis 306. Examples of the total internal reflection element 344 operate both as a lens element and a reflector element. For example, the total internal reflection element 344 can include a central region (proximate the optical axis 306) in the form of an upside down (or inverted) semicircle. This central region operates like a traditional lens element in that this portion of the total internal reflection element 344 refracts (i.e., bends) light from the light source 302 to form at least part of the light beam 310. The total internal reflection element 344 can also include one or more side surfaces (e.g., where region 318 is located). These side regions operate like a reflector element in that the light from the source strikes the surface at such a steep angle with respect to the normal of the surface (or greater than a so-called critical angle for lens material) that it cannot pass through the surface and instead reflects off the surface as if it were covered, e.g., with a material that is reflective. In one embodiment, the shape of the side surfaces is selected to form at least a part of the light beam 310 from light from the light source 302. In one example of the total internal reflection element 344, the central region has a focus point (e.g., focus point 328) that is different than the focus point (e.g., focus point 326) of the side surface.

In one example, the regions of the total internal reflection 344, e.g., the regions 318, 320, can have properties that permit light to diffuse or otherwise pass light from the light source 202. As shown in FIG. 4, the optical element 308 can have a focal signature 312 with focal groupings, which in turn comprises focus lines (e.g., a first focus line 322 and a second focus line 324) and focus points (e.g., a first focus point 326 and a second focus point 328). The characteristics desired for the light beam 310 can determine the position of the focus lines 322, 324 and focus points 326, 328. In one embodiment, the focus points 326, 326 for the optical element 308 are found outside of the imaging region 336 and spaced apart from the optical axis 306.

Figure 5:
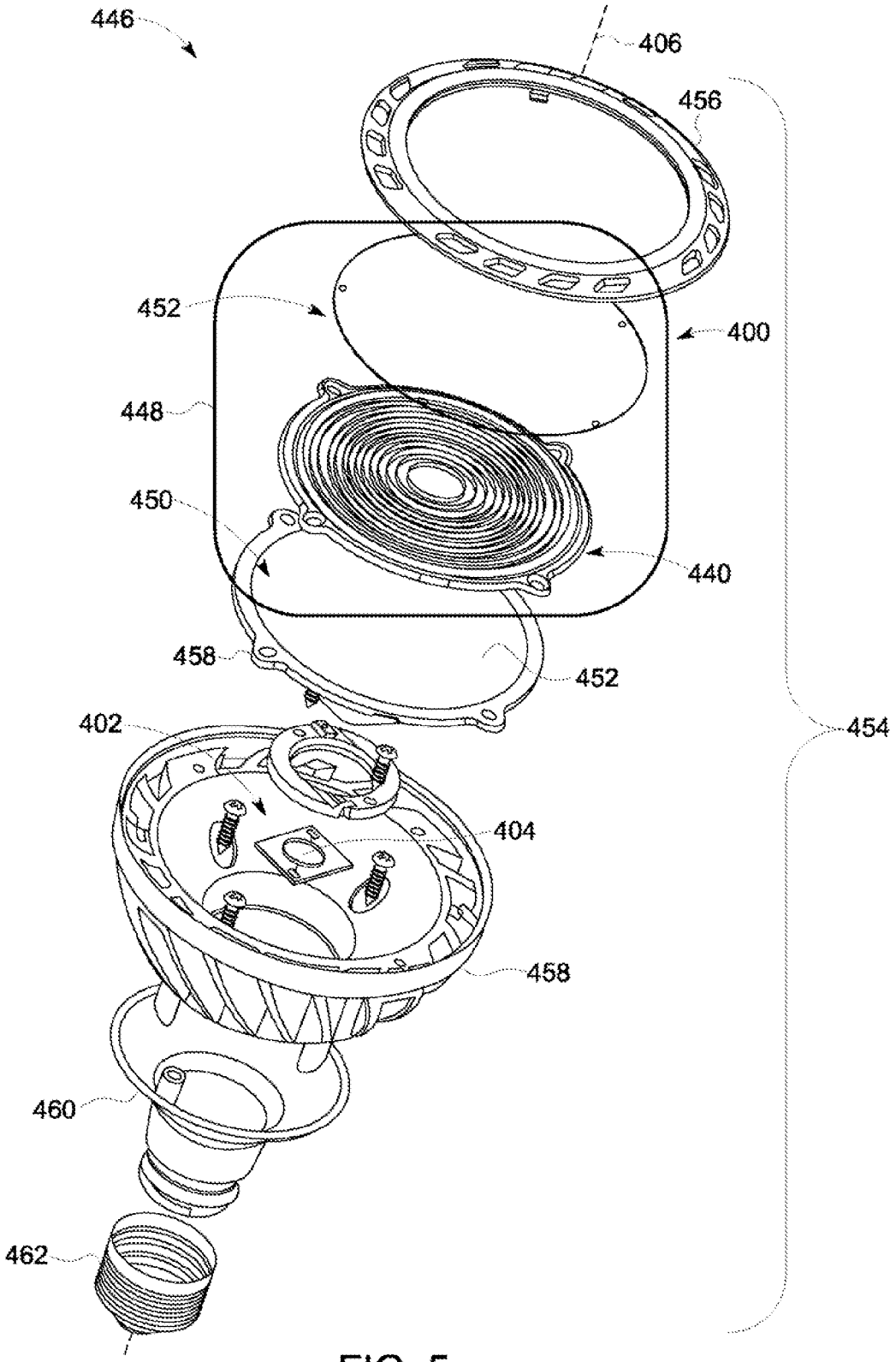
FIG. 5 illustrates an exploded assembly view of an exemplary lighting device that can use one of the optical systems of FIGS. 2, 3, and 4.

FIG. 5 depicts an exploded assembly view of an exemplary lighting device 446, examples of which can replace certain types of directional lamps, e.g., MR/PAR/R directional lamps. The lighting device 446 includes an optical system 400 with a light source 402 having an array of light-emitting diodes 404 as the primary light source. The optical system 400 also has an optical axis 406 and includes a lens element 440 that forms light from the light-emitting diodes 404 into a light beam. Although not shown in FIG. 5, the lens element 440 can have a plurality of focus points, one or more of which fall outside of an imaging region (e.g., imaging region 136 of FIG. 2, imaging region 236 of FIG. 3, imaging region 336 of FIG. 4) that bounds the light source 202 and is spaced apart from the optical axis 206. This configuration of the focus points in the lighting device 446 is different from the configuration of the focus points found in conventional directional lamps, in which the focus points of the lens converge to a single focus point is found proximate the light source (e.g., the light source 402) and along the optical axis (e.g., the optical axis 406) of the lighting device (e.g., the lighting device 400).

As also shown in FIG. 5, the lens element 440 is part of a beam forming optical system 448 with elements that are useful to form light from the light source 402 into the light beam. The beam forming optical system 448 also includes a reflector 450 forming a reflective surface 452 about the optical axis 406. The reflector element 450 spaces the lens element 440 apart from the light source 402. In one embodiment, the beam forming optical system 448 also has a diffuser element 452, which can further modify properties of the light that passes through the lens element 208. However, manipulation of the position of the focus points can influence design and construction of the diffuser element 452 and, in one or more embodiments of the lamp 200, the diffuser element 452 is optional and/or excluded altogether from the lamp 200. In other embodiments, the beam forming an optical system 448 can comprise a reflector element (e.g., reflector element 242 of FIG. 3) and/or a total internal reflection element (e.g., total internal reflection element 344 of FIG. 4) in lieu of and/or in combination with the lens element 440 and/or other components, e.g., the reflector 450 and the diffuser element 452.

FIG. 5 also shows one construction of a housing assembly 454 for the lighting device 446. The housing assembly 454 includes one or more retaining rings (e.g., a first retaining ring 456 and a second retaining ring 458) that help to fasten elements (e.g., the beam forming optical system 448) of the lighting device 446 to a heat sink component 458. The heat sink component 458 is in thermal relation to the light source 402 to dissipate heat, e.g., heat the array of LED devices 204 generates during operation of the lighting device 446. The housing assembly 454 also includes a body member 460 and a connector 462, which together can house a variety of electrical components and circuitry that drive and control the light source 402. The connector 462 can mate with Edison-type lamp sockets found in U.S. residential and office premises as well as other types of sockets and connectors that conduct electricity to the components of the lighting device 446. In other examples of the lighting device 446, the connector 462 can be a bayonet-type base or other standard base chosen to comport with the receptacle of choice.

Examples of the LEDs 404 can encompass organic and inorganic light-emitting diodes (LED) devices of various constructions. These LED devices can comprise bare semiconductor chips, encapsulated semiconductor chips, as well as various configurations of chip packages in which the LED device is mounted on one or more intermediate elements such as a sub-mount, a lead-frame, and a surface mount support. In one or more examples, the LED device can incorporate a reflective member in the form of a cup, dome, cylinder, and/or other shape to direct light, e.g., away from the light source 402 toward the lens element 440. In still other examples, the LEDs 404 can comprise a coating or other material layer, e.g., a wavelength-converting phosphor coating with or without an encapsulant.

Examples of the reflector 452 may include conical and/or frusto-conical members that revolve about the optical axis 406. These members can have an entrance aperture proximate the light source 402 and an exit aperture proximate the lens element 440. This configuration permits light from the light source 202 to pass through the reflector 452 to the lens element 440. Dimensions for the exit aperture allow the reflector 452 to fit into the housing assembly 454, which can itself be dimensionally constrained to fit within industry standard form factors, standards set forth for the MR/PAR/R directional lamps.

The reflector 450 can comprise various metals (e.g., aluminum), plastics, and composites that provide sufficient strength and reliability as well as meet certain cost constraints for products of this type. The reflective surface 452 can exhibit high optical reflectivity. This feature may be a material property of the reflector 450 as constructed. In one example, a coating or material layer is disposed on the inner surface to form the reflective surface 452. Exemplary materials include a coated aluminum material by ALANOD Aluminum-Verdlung GMBH & Co. KG having about 92% to 98% visible reflectance and a polymer film produced by 3M having about 97% to 98% visible reflectance.

As used herein, an element or function recited in the singular and proceeded with the word "a" or "an" should be understood as not excluding plural said elements or functions, unless such exclusion is explicitly recited. Further-more, references to "one embodiment" of the claimed invention should not be interpreted as excluding the existence of additional embodiments that also incorporate the recited features.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lighting device, comprising:

a light source comprising an array of light-emitting diodes, the light source aligned on an optical axis; and a beam forming optical system to form light from the light source into a light beam, the beam forming optical system comprising an optical element having a plurality of focus points, at least one of which is spaced apart from the optical axis and falls outside of an imaging region that bounds the light source, the imaging region having a boundary spaced apart from the light source;

wherein the beam forming optical system further comprises a frusto-conical reflector that revolves about the optical axis, and wherein the frusto-conical reflector has an entrance aperture proximate the light source and an exit aperture proximate the optical element.

2. The lighting device of claim 1, wherein the optical element comprises a lens element disposed in the path of light, and wherein the lens element comprises a plurality of optical facets that form the light beam.

3. The lighting device of claim 1, wherein the optical element comprises a total internal reflection element.

4. The lighting device of claim 1, wherein the optical element comprises a Fresnel lens.

5. The lighting device of claim 1, wherein at least one of the plurality of focus points is found in the imaging region.

6. The lighting device of claim 1, wherein optical element comprises a plurality of concentric rings of material forming regions that correspond to each of the plurality of focus points.

7. The lighting device claim 1, wherein one of the focus points is found on the optical axis.

8. A lighting device, comprising:

an array of light emitting diodes; and an optical element comprising a Fresnel lens spaced apart from the array of light emitting diodes and positioned to receive light from the array, the optical element having a plurality of focus points, at least one of which is spaced apart from the optical axis and falls outside an imaging region;

the lighting device further comprising a frusto-conical reflector that revolves about the optical axis, and wherein the frusto-conical reflector has an entrance aperture proximate the light emitting diodes and an exit aperture proximate the optical element.

9. The lighting device of claim 8, further comprising a heat sink disposed in thermal relation to the light emitting diode.

10. The lighting device of claim 1, wherein at least three of the plurality of focus points are spaced apart from the optical axis and fall outside the imaging region.

* * * * *